US006536356B2

(12) United States Patent
Krieger et al.

(10) Patent No.: US 6,536,356 B2
(45) Date of Patent: Mar. 25, 2003

(54) COMPUTER DESK

(75) Inventors: Douglas P. Krieger, Archbold, OH (US); Michael D. Lambright, Archbold, OH (US); Daniel G. Kovar, Lyons, OH (US); Gregory D. Fleming, West Unity, OH (US); Scott R. Davidson, Lakewood, NY (US); Donald R. Pangborn, Jamestown, NY (US)

(73) Assignee: Sauder Woodworking Co., Archbold, OH (US)

( * ) Notice: Subject to any disclaimer, the term of this patent is extended or adjusted under 35 U.S.C. 154(b) by 0 days.

(21) Appl. No.: 09/876,829

(22) Filed: Jun. 7, 2001

(65) Prior Publication Data

US 2002/0043185 A1 Apr. 18, 2002

Related U.S. Application Data

(60) Provisional application No. 60/210,533, filed on Jun. 8, 2000.

(51) Int. Cl.[7] ..... A47B 35/00

(52) U.S. Cl. ..... 108/50.01; 108/147; 108/10

(58) Field of Search ..... 108/92, 50.01, 108/50.02, 147, 2, 3, 6, 9, 7, 10, 67; 312/223.1, 194, 195; 248/917, 919, 921, 922, 923, 918

(56) References Cited

U.S. PATENT DOCUMENTS 5,287,815 A * 2/1994 Gross ..... 108/50.01
5,403,082 A * 4/1995 Kramer ..... 108/115
5,483,898 A * 1/1996 Seidl ..... 108/3
5,704,299 A * 1/1998 Corpuz et al. ..... 108/147
5,758,849 A * 6/1998 Bui et al. ..... 108/145
5,778,799 A * 7/1998 Eyre ..... 108/10
5,845,586 A * 12/1998 Moore ..... 108/50.01
5,857,415 A * 1/1999 Richard ..... 108/10
5,967,631 A * 10/1999 Ko ..... 108/50.01
6,038,986 A * 3/2000 Ransil et al. ..... 108/145

FOREIGN PATENT DOCUMENTS

DE 4009536 * 9/1991

* cited by examiner

*Primary Examiner*—Janet M. Wilkens
*Assistant Examiner*—Hanh V. Tran
(74) *Attorney, Agent, or Firm*—Emch, Schaffer, Schaub & Porcello Co., L.P.A.

(57) ABSTRACT

A computer desk including a base, a front member and at least one side member. The front member has a front surface and a back surface. The front surface is positioned at a predetermined negative angle with respect to the back surface. A hinge assembly is operatively connected to the base, the front member and the side member for allowing pivotal movement of the front and back surfaces with respect to the base. The hinge assembly includes a handle operatively connected to a cylinder to control such pivotal movement. The back surface can be used to support a computer keyboard. The front surface can be used to support the arms of a person using the desk.

6 Claims, 5 Drawing Sheets

COMPUTER DESK

RELATED APPLICATION

The present application relates to and claims the benefit of U.S. Provisional Patent Application No. 60/210,533, filed on Jun. 8, 2000.

BACKGROUND OF THE INVENTION

The present invention relates generally to a desk. More specifically, the invention is directed to a computer desk including a front member that is pivotally mounted on a base.

Desks are known in the art. In the past, desks have included a flat work surface that was fixedly attached to a base. These types of desks were acceptable for use by a person who was writing or reading at the desk. However, these types of desks were unsatisfactory with the development of personal computers having keyboards. A person using a computer at the above-described desk found that the use of a keyboard was difficult because it rested on the flat work surface and there was nowhere to rest his or her arms during use of the keyboard.

In order to overcome some of the disadvantage of traditional desks, desks were developed that included a keyboard surface that could be tilted at a positive angle in relation to a desk having a flat surface that supported, for example, a computer monitor. It has been found that these desks are unsatisfactory because they do not provide a keyboard surface that can position a keyboard in a variety of positions at a negative angle for comfortable use of the keyboard by a user. Further, the prior art desks do not provide a surface upon which a user may rest his or her arms during use of the keyboard.

In view of the foregoing, the present invention provides a desk that overcomes the above-identified problems associated with prior desks.

SUMMARY OF THE INVENTION

The present invention is directed to a computer desk including a base, a front member having a front surface and a back surface and at least one side member. The front surface is positioned at a predetermined negative angle with respect to the back surface. A hinge assembly is operatively connected to the base, the front surface, the back surface and the side member for allowing pivotal movement of the front and back surfaces with respect to the base.

The primary object of the present invention is to provide a desk having a keyboard surface that can be variably positioned at a negative angle for the comfortable use of the keyboard by a person using the keyboard.

It is an important object of the present invention to provide a desk having a surface upon which a person using a keyboard can place his or her arms.

Other objects and advantages of the present invention will become apparent to those skilled in the art upon a review of the following detailed description of the preferred embodiments and the accompanying drawings.

DETAILED DESCRIPTION OF THE PREFERRED EMBODIMENT

Figure 1:
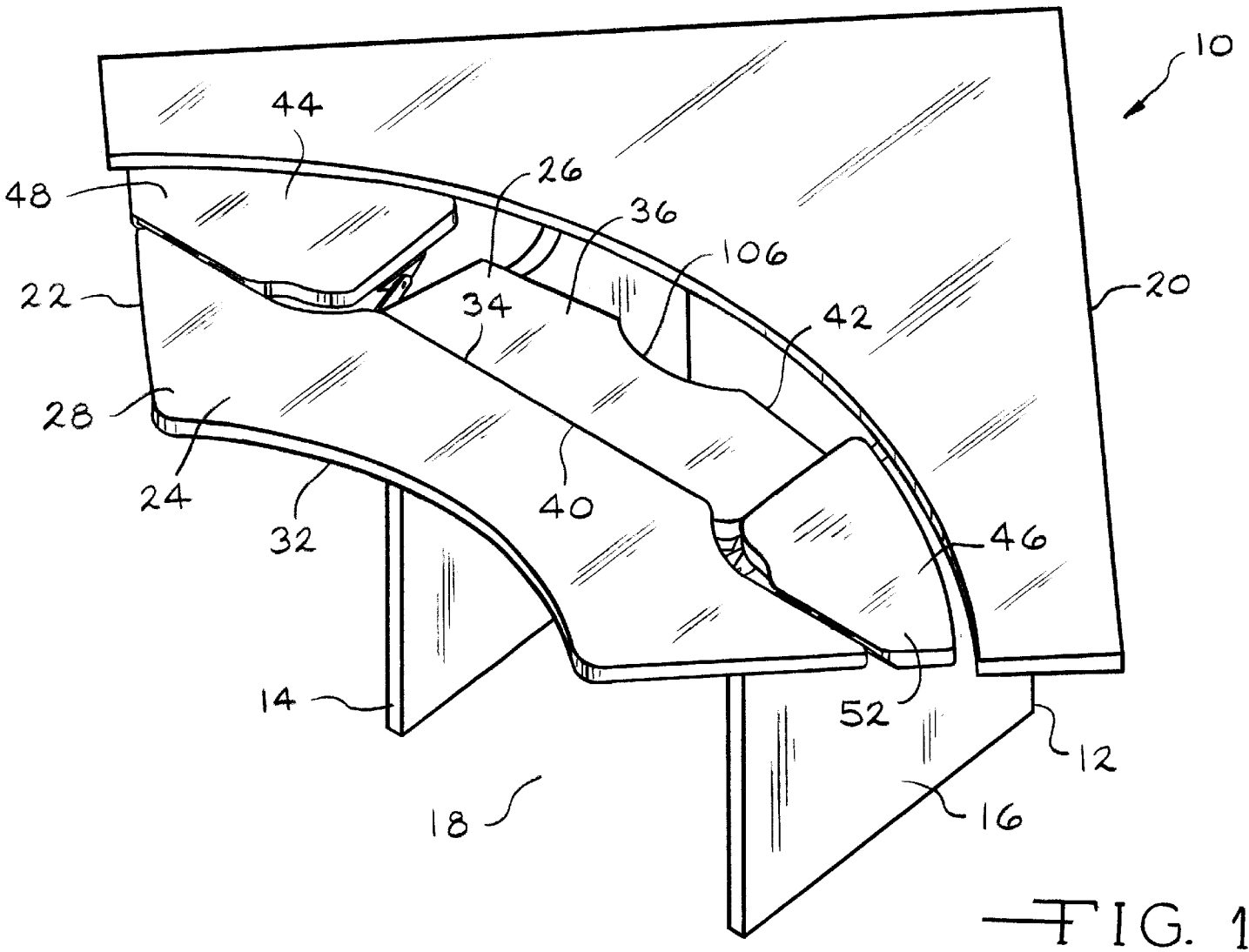
FIG. 1 is a top perspective view of a desk according to the present invention.

The preferred embodiment and best mode of the present invention will now be described in detail with reference being made to the drawings. The computer desk of the present invention is indicated generally in the drawings by the reference number "10".

Figure 2:
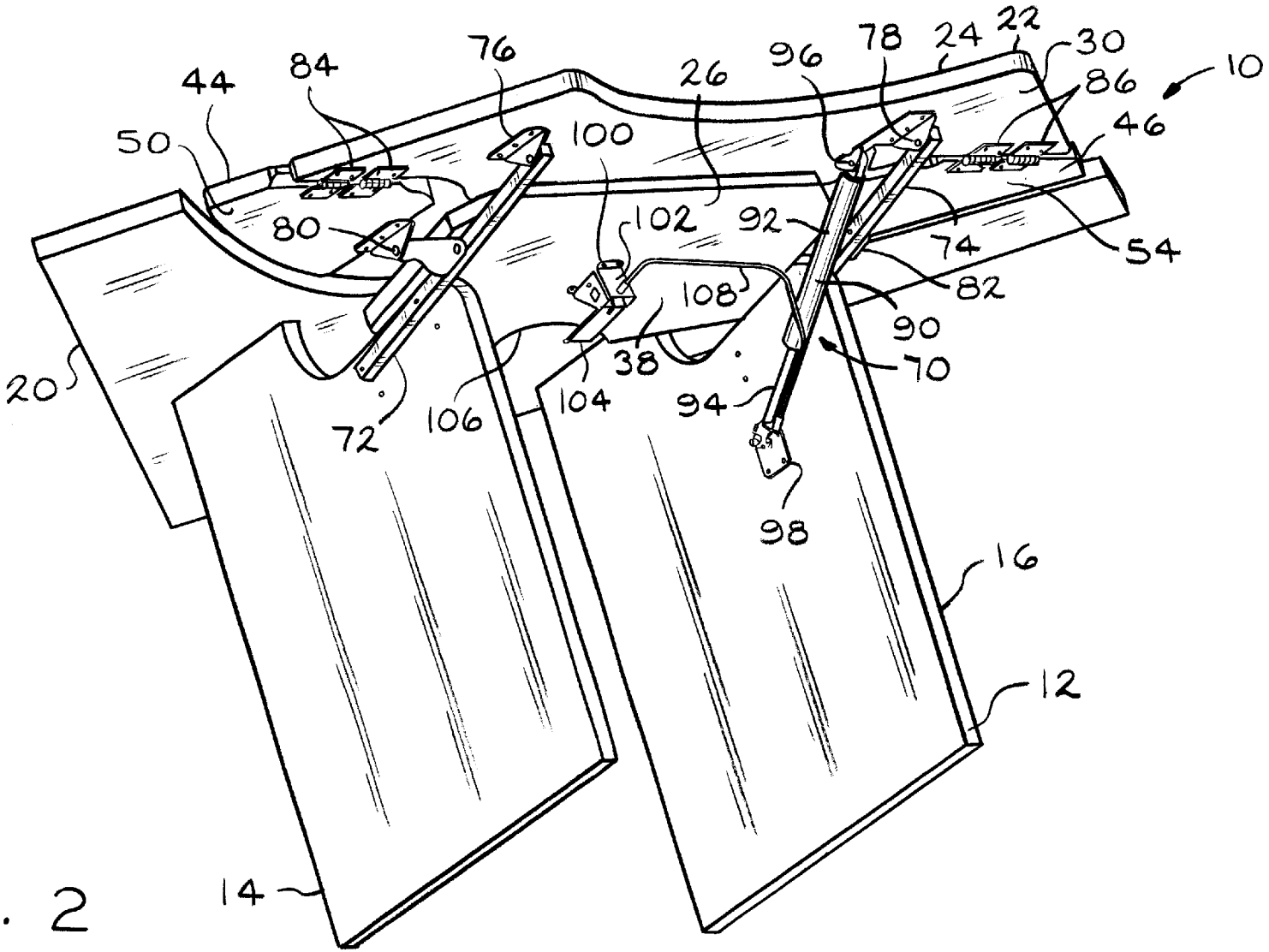
FIG. 2 is a bottom perspective view of a desk according to the present invention.
Figure 3:
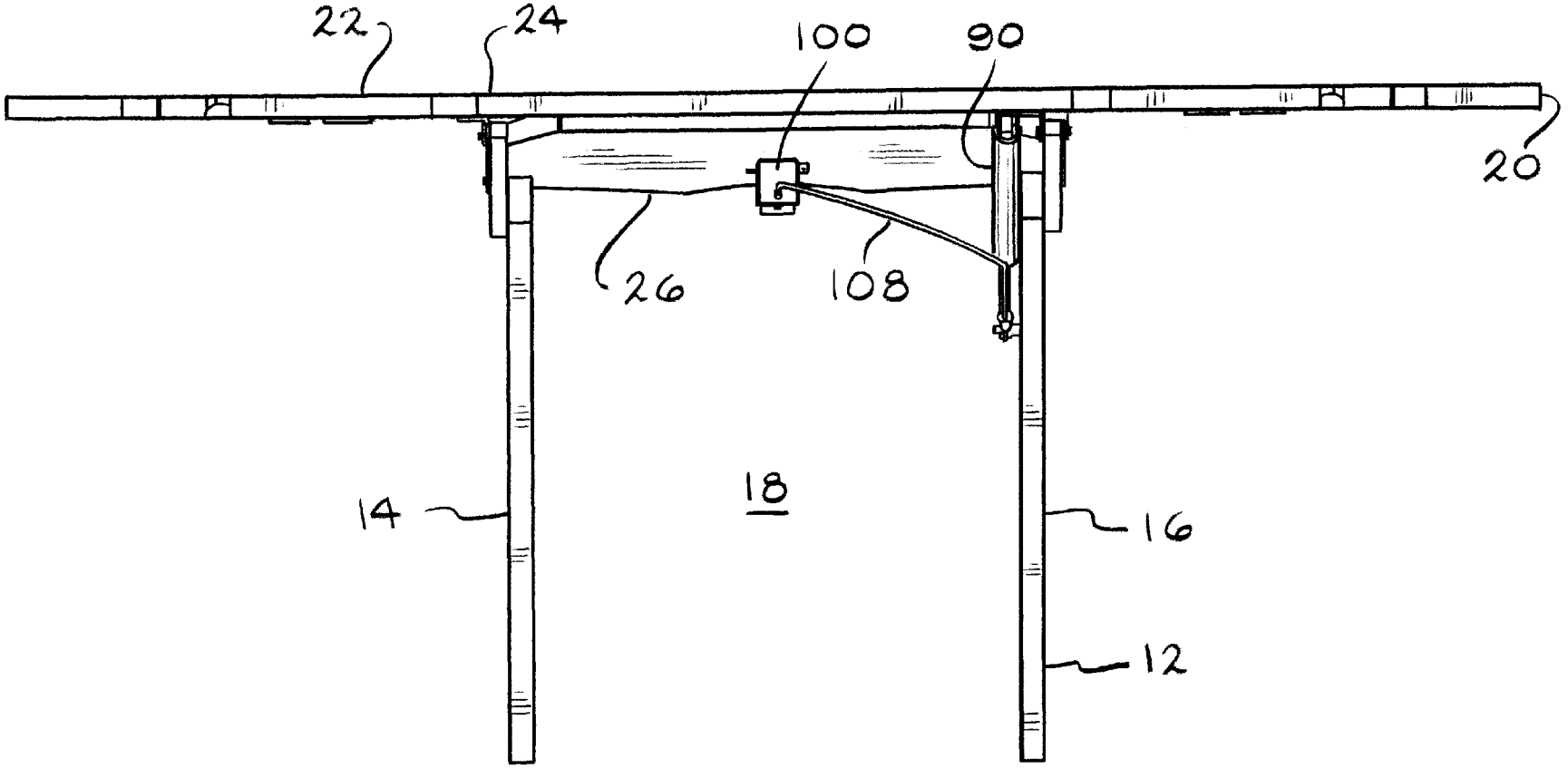
FIG. 3 is a front elevational view of a desk according to the present invention.

Referring to FIGS. 1–3, the desk 10 has a base 12 that includes a first pedestal 14 spaced from a second pedestal 16. The first and second pedestals 14 and 16 define a knee-hole opening 18 for receiving the legs of a person seated at the desk 10.

Referring again to FIGS. 1–3, the base 12 includes a stationary surface 20 extending longitudinally between the first and second pedestals 14 and 16. The stationary surface 20 can support, for example, a computer monitor (not shown).

Referring still to FIGS. 1–3, the desk 10 includes a front member 22 having a front surface 24 and a back surface 26. The front surface 24 includes a top 28, a bottom 30, a front 32 and a back 34. The back surface 26 includes a top 36, a bottom 38, a front 40 and a back 42. The top 36 of the back surface 26 can support, for example, a computer keyboard (not shown). The front 32 of the front surface 24 is concave in order to receive the torso of a person seated at the desk 10. The top 28 of the front surface 24 can support the arms of a person seated at the desk 10. Further, the top 28 can be used for writing and reading by a person seated at the desk 10.

Figure 4:
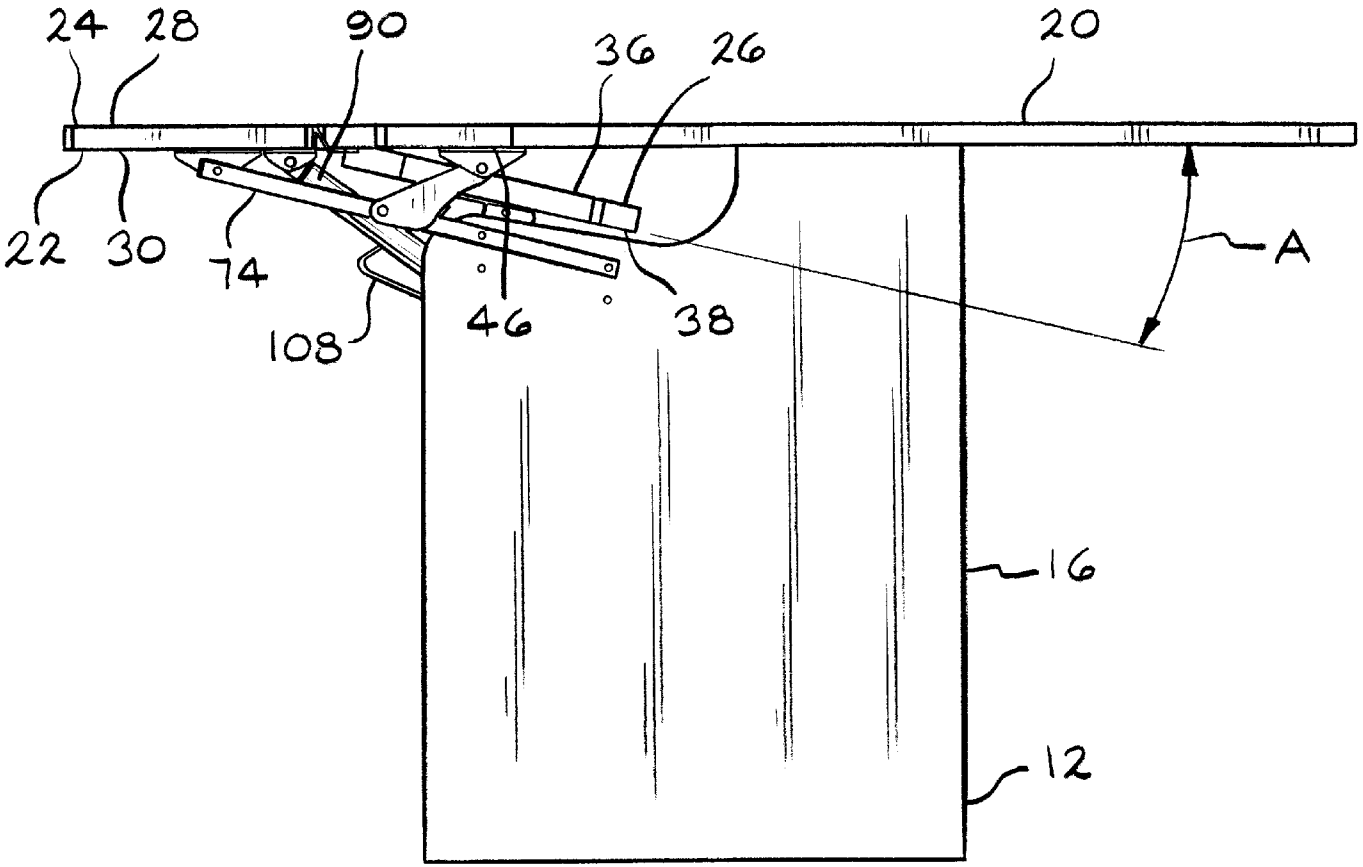
FIG. 4 is a side elevational view of a desk according to the present invention in which the front member is in a first position.
Figure 5:
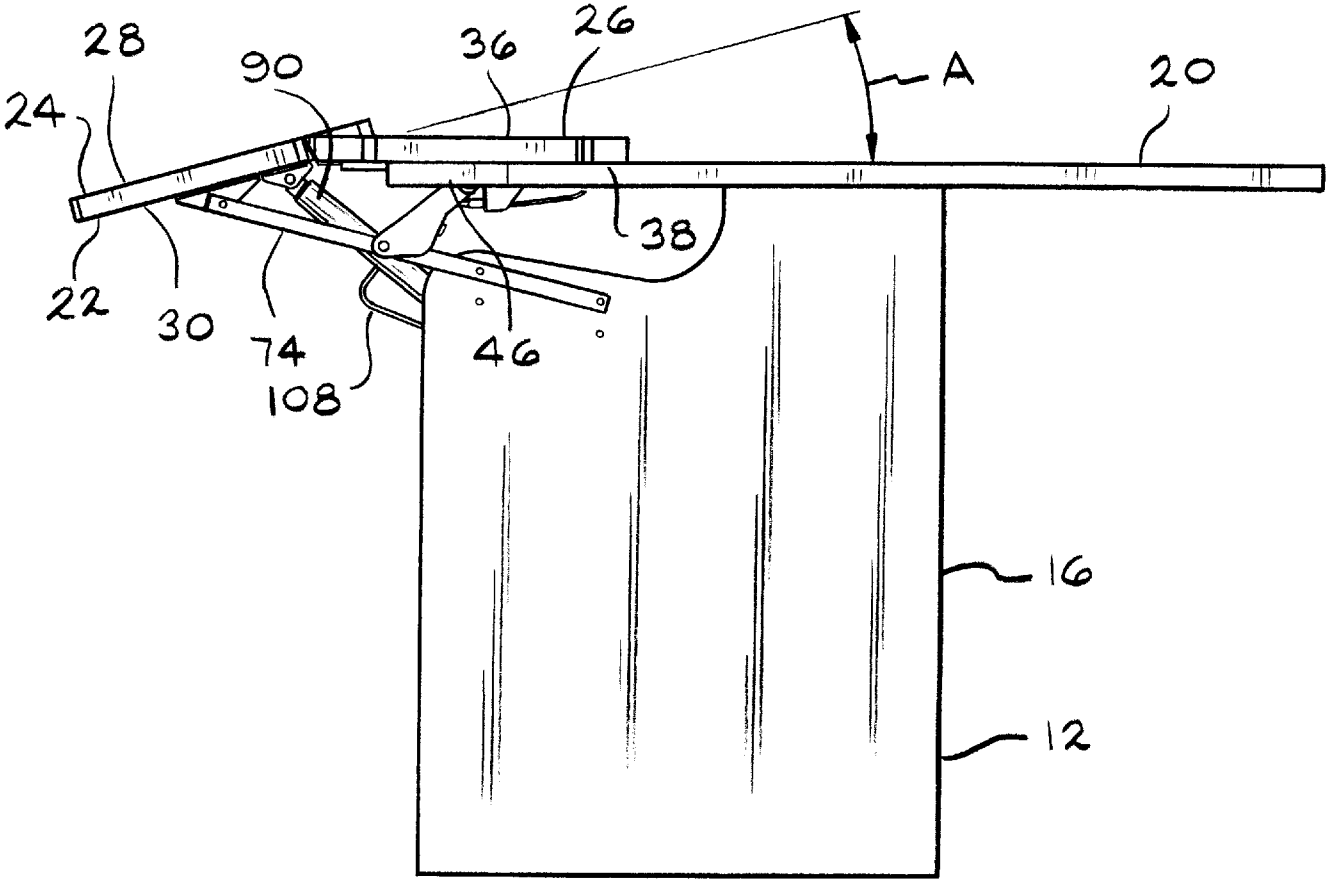
FIG. 5 is a view similar to the view of FIG. 4 in which the front member is in a second position.

Referring now to FIGS. 1–5, the front surface 24 is positioned at a predetermined negative angle A with respect to the back surface 26 (FIGS. 4 and 5). The predetermined angle A is greater than −5°. In a preferred embodiment, the predetermined angle A is about −12.5°. The predetermined angle A allows the top 28 of the front surface 24 to be on a different plane than the top 36 of the back surface 26. This allows for the computer keyboard to be on a different plane than the top 28 of the front surface 24 upon which the arms of a user of the desk 10 are positioned. It has been found that the predetermined angle A increases the comfort of the user during use of the keyboard.

As shown in FIGS. 1 and 2, the desk 10 includes a first side member 44 spaced from a second side member 46. The back surface 26 of the front member 22 is positioned between the first and second side member 44 and 46. The first side member 44 includes a top 48 and a bottom 50. The second side member 46 includes a top 52 and a bottom 54. The tops 48 and 50 of the first and second side member 44 and 46, respectively, can support, for example, a computer mouse (not shown). If a user of the desk 10 is right handed, the second side member 46 would be used to support the mouse. If the user is left handed, the first side member 44 would be used to support the mouse.

Referring to FIGS. 2–4, the desk 10 includes a hinge assembly 70 that is operatively connected to the base 12, the front surface 24, the back surface 26 and the first and second side members 44 and 46 for allowing pivotal movement of the front and back surfaces 24 and 26 with respect to the base 12. As best shown in FIG. 2, the hinge assembly 70 includes a first base member 72 and a second base member 74. The first and second base members 72 and 74 are adjustably mounted on the first and second pedestals 14 and 16, respectively, of the base 12. The first and second base members 72 and 74 are pivotally attached by first and second pivot brackets 76 and 78, respectively, to the bottom 30 of the front surface 24. The first and second base members 72 and 74 are pivotally attached by first and second pivot members 80 and 82, respectively, to the bottoms 50 and 54 of the first and second side member 44 and 46, respectively. A first pair of hinge members 84 is attached to the bottom 30 of the front surface 24 and the bottom 50 of the first side member 44. A second pair of hinge members 86 is attached to the bottom 30 of the front surface 24 and the bottom 54 of the second side member 46.

Still referring to FIG. 2, the hinge assembly 70 includes a cylinder 90 having a cylinder body 92 and a reciprocating rod 94. An example of a cylinder 90 that can be used in the present invention is a spring-loaded cylinder. The cylinder body 92 is pivotally attached by a cylinder bracket 96 to the bottom 30 of the front surface 24. The rod 94 is pivotally attached by a rod bracket 98 to the second pedestal 16.

The hinge assembly 70 includes a handle assembly 100 having a handle bracket 102 that is mounted on the bottom 38 of the back surface 26 and a movable handle 104. As shown in FIGS. 1 and 2, the back 42 of the back surface 26 includes a recess 106 that allows for easy access to the handle 104 by a user of the desk 10.

Referring again to FIG. 2, the handle 104 is attached to an actuation member 108 that extends to the cylinder 90. Actuation of the handle 104 allows for movement of the reciprocating rod 94 of the cylinder 90.

Referring to FIGS. 4 and 5, the hinge assembly 70 allows for pivotal movement of the front and back surfaces 24 and 26 from a first position as shown in FIG. 4 to a second position as shown in FIG. 5 and a variety of positions therebetween. As shown in FIGS. 4 and 5, the first and second side members 44 and 46, as represented by second side member 46, remain in level positions during pivotal movement of the front and back surfaces 24 and 26. This allows the computer mouse to remain level during pivotal movement of the front member 22 with respect to the base 12. The cylinder 90 acts to maintain the front member 22 in a predetermined position with respect to the base 12.

The above detailed description of the present invention is given for explanatory purposes. It will be apparent to those skilled in the art that numerous changes and modifications can be made without departing from the scope of the invention. Accordingly, the whole of the foregoing description is to be construed in an illustrative and not a limitative sense, the scope of the invention being defined solely by the appended claims.

We claim:

1. A desk comprising:

a base;

a front member including a front section having a bottom and a back section having a bottom, said front section being positioned at an angle with respect to said back section, said back section including a handle recess;

at least one side member;

a hinge assembly connected to said base, said front section, said back section and said side member for allowing pivotal movement of said front and back sections with respect to said base, said hinge assembly including a cylinder having a cylinder body and a reciprocating rod extending between said base and said bottom of said front section, a handle positioned on said bottom of said back section adjacent to said handle recess and an actuation member extending between said handle and said cylinder; and a stationary section positioned on said base, said back section being positioned between said front section and said stationary section.

2. The desk of claim 1, wherein said base includes at least one pedestal.

3. The desk of claim 2, wherein said base includes two spaced pedestals defining a knee-hole opening.

4. The desk of claim 1, wherein said at least one side member includes two spaced side members wherein said back section is positioned between said two spaced side members.

5. The desk of claim 1, wherein said at least one side member remains level with respect to said base during pivotal movement of said front and back surfaces.

6. The desk of claim 1, wherein said hinge assembly includes a first base member and a second base member, said first and second base members being positioned between said front member and said base.

* * * * *